United States Patent [19]

Bystedt

[11] Patent Number: 4,718,611

[45] **Date of Patent: * Jan. 12, 1988**

[54] DEVICE FOR PRODUCTION OF MECHANICAL PULP

[75] Inventor: Hjalmar S. I. Bystedt, Enebyberg, Sweden

[73] Assignee: Sunds Defibrator, AB, Stockholm, Sweden

[ * ] Notice: The portion of the term of this patent subsequent to Jun. 26, 2001 has been disclaimed.

[21] Appl. No.: 165,120

[22] Filed: Jul. 1, 1980

[30] Foreign Application Priority Data

Jul. 6, 1979 [SE] Sweden ..... 7905942

[51] Int. Cl.[4] ..... B02L 7/11

[52] U.S. Cl. ..... 241/43; 241/134; 241/281

[58] Field of Search ..... 241/18, 28, 57, 152 A, 241/280, 296, DIG. 14, 278, 281, 282, 297, 55, 38, 43, 134

[56] References Cited

U.S. PATENT DOCUMENTS 3,224,687 12/1965 Bidwell ..... 241/55

4,017,356 4/1977 Bystedt ..... 241/280 X 4,270,703 6/1981 Haikkala ..... 241/18

*Primary Examiner*—Timothy V. Eley

*Attorney, Agent, or Firm*—Eric Y. Munson

[57] ABSTRACT

The invention relates to a device for the production of mechanical pulp from a lignocellulose material, comprising a grinding disc (1) rotating round a shaft (2) running at right-angles through the center of each end surface of the disc, and means (10–13) for holding and pressing one or more pieces of the material to be processed against one or both of these end surfaces, which are given the form of grinding surfaces, for fibres of the material to be processed being essentially oriented in the plane of the grinding surface, and water, which may contain chemicals, being introduced during the grinding process. The grinding disc is enclosed in a housing (5) kept at above-atmospheric pressure. The means for holding the material to be processed is so designed as to hold the pieces of such material with their fibres largely pointing in a direction outwards from the center of the grinding device. The means (7) for introducing water into the grinder is so designed as to carry water to the center of the grinding device.

3 Claims, 7 Drawing Figures

DEVICE FOR PRODUCTION OF MECHANICAL PULP

The present invention relates to a device for the production of mechanical pulp from a lignocellulose material, in which one or more pieces of such material are held fast and, while water, which may contain chemicals, is introduced into the device, are pressed against at least one grinding zone on one or both end surfaces of a grinding disc rotating round a shaft at right-angles to the two end surfaces of the grinding disc in an enclosed housing kept at a pressure above atmospheric.

The conventional method of liberating the fibres of lignocellulose material requires the material, usually logs or pieces of wood, to be pressed against the surface of the mantle of a cylindrical grindstone while water is added to the grinder. The grindstone rotates openly under atmospheric pressure.

In spite of the fact that many improvements have been made over the course of the years, there are inherent limitations in this method of grinding. The grinding capacity of the stone can only be increased as far as the limits set by its length, diameter and speed of rotation. If the length and diameter of the stone are increased, the load to which the stone and shaft are subjected, as a result of the greater weight of the stone in combination with the pressure of the wood against the grinding surface, will be increased by a corresponding amount. Increasing the length of the stone increases the bending moment of both stone and shaft, while dynamic stresses increase with the greater weight and faster rotation of the stone. High rotation speeds tend to increase the stresses set up in the stone by centrifugal force, with the result that the ceramic material and binding agent of which stones of this type are normally composed may shatter. In addition, the centrifugal force set up by the higher speed tends to hurl both the wood and the water sprayed into the grinder outwards from the grinding surface of the stone.

The grinding process requires large amounts of energy, and a great deal of heat is generated by the friction of the wood against the stone. Much of this heat is absorbed by the stone, which is then cooled by water sprayed on at a point beyond the grinding zone. Since the thermal conductivity of the material of which it is made is poor, the surface of the stone gets very hot and the thermal stresses set up thereby may cause the stone to crack.

All these factors combine to limit the production capacity of the grinding stone, meaning that the amount of energy needed to produce a tonne of pulp will be correspondingly high. Furthermore, the quality of the pulp produced by this method is itself limited by the properties of the machine described above. The grinding surface of the stone consists of sharp grains of ceramic material embedded in a binding agent. As the grains wear out, the grinding surface becomes more and more smooth and production falls off at the same time as the pulp becomes too finely ground. The surface must then be reconditioned by a burr which cuts a new grinding pattern in the surface of the stone. Since the state of the grinding surface is continually changing during the pulping process the quality of the groundwood pulp itself will vary. When the grains are sharp they tend to rip the fibres out of the wood, giving a short-fibred, low-strength pulp, although improvements may be made by using the "hot grinding" technique in which the water system is closed and the water sprayed onto the stone consists of hot white water from the grinding process. Thus heated, the wood becomes softer and its fibres can be liberated with less damage than in the cold grinding process. However, the degree to which the wood may be heated is limited by the fact that the stone still needs to be cooled, and since the process is unenclosed and takes place under ordinary atmospheric pressure the upper temperature of the grinding zone will be 100° C. A further result of high temperatures is that so much steam is driven off that the wood becomes dried-out, and this has a detrimental effect on the quality of the pulp. In order to obviate these drawbacks it has recently become the practice to keep the grindstone at a pressure above atmospheric, although this still does not do away with the other disadvantages inherent in the stone.

Attempts have been made to provide the cylindrical mantle of the stone with a grinding surface of steel having small, projecting ridges whose height and radius of curvature are suitable for grinding. Surfaces of this nature have succeeded in producing pulp of satisfactory quality, but the method has not become generally used in practice. Curved grinding elements of this type are extremely costly since they must be manufactured to close tolerances and frequently need changing as a result of wear, as encountered in all grinding surfaces, which entirely neutralizes any benefits they may have.

Disc refiners are also used for producing mechanical pulp, such refiners usually having two patterned grinding discs of steel or cast iron. These grinding discs rotate opposite each other, either one rotating and the other standing still or both rotating in opposite directions. In this case the wood is not held fast as in grinding but is continually introduced into the space between the discs in the form of chips. It is therefore possible to use small-dimensioned wood, sawmill residue, planer shavings, sawdust, etc., unsuitable for grinding. Although this method gives pulp of good quality, energy consumption is high.

The chief objective of the present invention is to achieve a device which, besides eliminating the disadvantages described above, considerably increases the grinder's capacity, uses less energy per tonne of pulp and improves the quality of the pulp itself.

This and other objectives are realized in a grinding device comprising a grinding disc rotating round a shaft running through the centre of each end surface of the disc, and means for holding and pressing one or more pieces of the material to be processed against one or both of the end surfaces, which are given the form of grinding surfaces, the fibres of the material to be processed being essentially oriented in the plane of the grinding surface, and water, which may contain chemicals, being introduced during the grinding process: the objectives of the invention are essentially achieved in that the grinding surface is enclosed in a housing kept at above-atmospheric pressure; in that the means for holding the material is so designed as to hold the pieces of such material with their fibres largely pointing in a direction outwards from the centre of the grinding device; and in that the means for introducing water into the grinder is so designed as to carry water to the centre of the grinding disc.

Further characteristics of the new grinding device will be apparent from the claims to follow, and an embodiment of the invention is described in the following paragraphs by reference to the attached illustrations.

FIG. 1 of the illustrations shows a horizontal section through the grinding apparatus;

Figure 1:
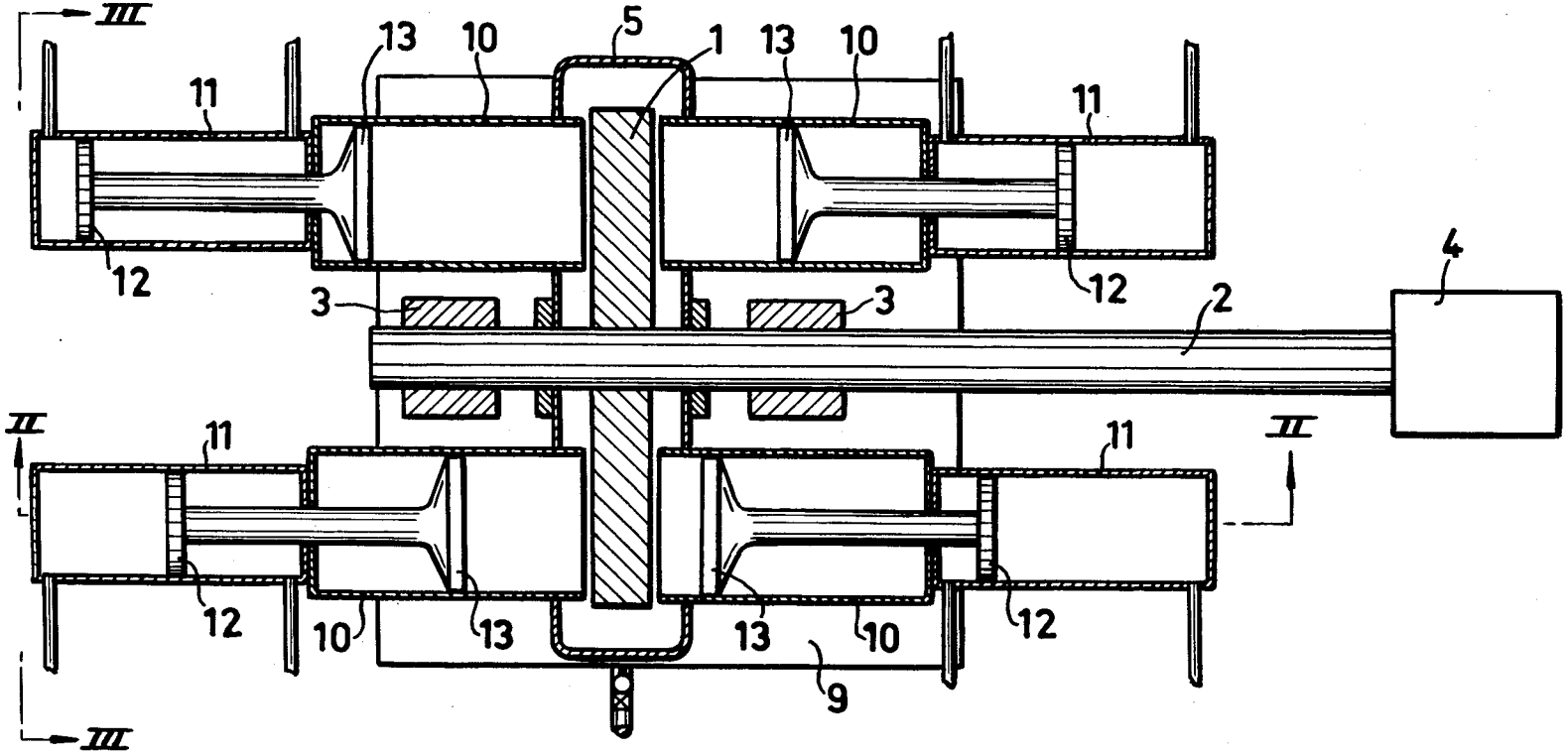
Figure 2:
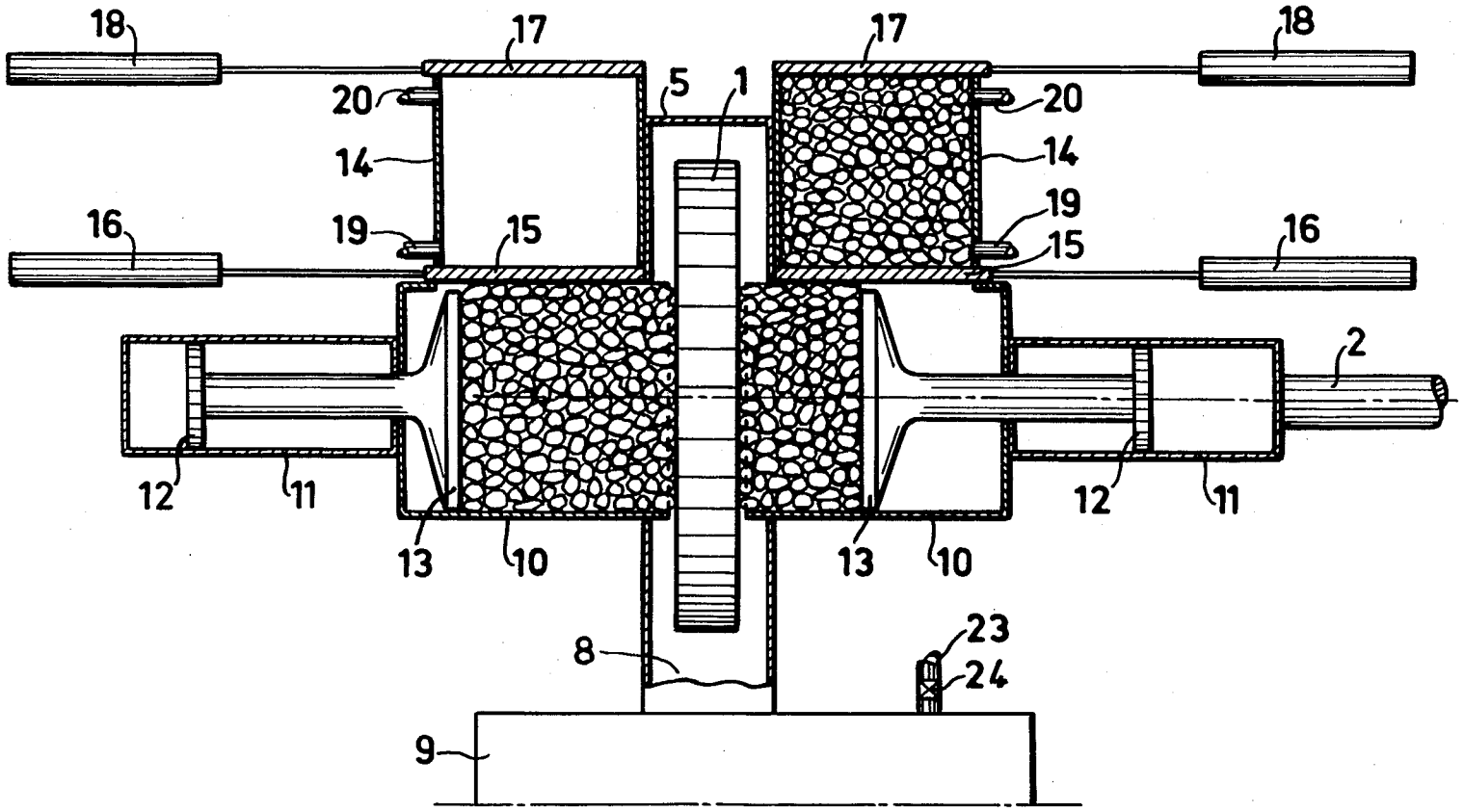
FIG. 2 shows a vertical section through two grinding pockets opposite each other.
Figure 3:
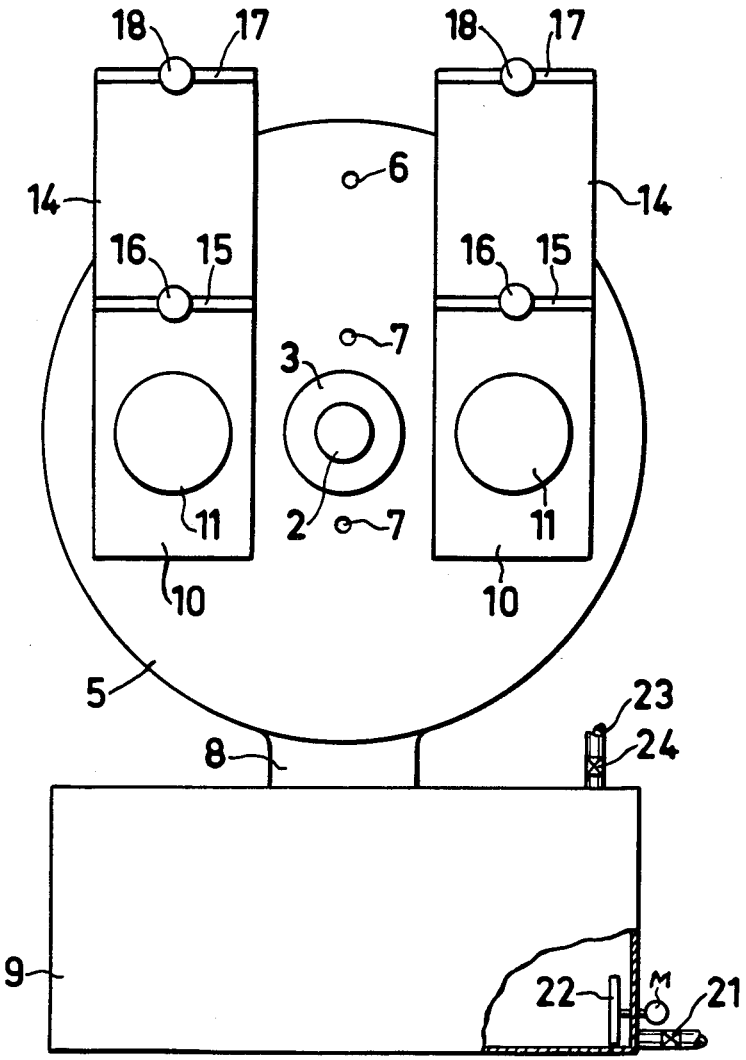
FIG. 3 shows a vertical view of the exterior of the device seen in an axial direction.
Figure 4:
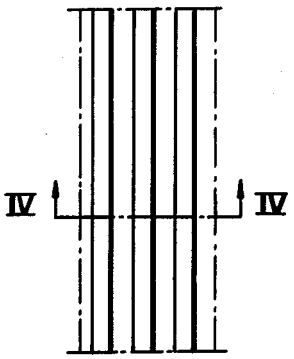
FIGS. 4 and 5 show two alternative patterns for the surface of the grinding disc.
Figure 4A:
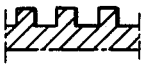

FIG. 4*a* is a cross section taken along the line IV—IV of FIG. 4, and

Figure 5:
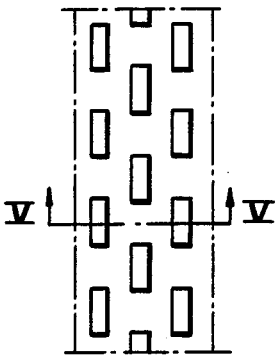
Figure 5A:
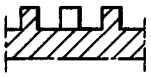

FIG. 5*a* is a cross section taken along the line V—V of FIG. 5.

A grinding disc 1 is carried on a horizontal shaft 2 supported by bearings 3 also able to take up axial loads in either direction. The shaft is driven by a motor 4. Both sides of the grinding disc, which are plane in section, are furnished with a grinding surface given a specially designed grinding pattern and made of steel, cast iron, hardmetal or other material having high resistance to wear. This grinding pattern consists of ribs (see FIG. 4) or raised teeth (see FIG. 5), the edges of which carry out the major part of the work of cutting into the wood and liberating its fibres. The edges of the ribs or teeth point essentially outward from the centre of the grinding disc. Since the edges are thus oriented in the same direction as the fibres of the wood, the fibres themselves will not be cut out of the wood but will be worked loose along their length and remain virtually intact. This produces a pulp with excellent strength potential.

The grinding disc is enclosed in a housing 5 provided with a steam intake 6, four water inlets 7 and a lower opening 8 connected to a pressure tank 9. Inside the housing, cavities are provided for four grinding pockets 10, two of these being located opposite to the two others on each side of the grinding disc. A compression cylinder 11 and plunger 12 connected to a thrust plate 13 fitting inside the pocket are mounted at the outer end of each pocket.

Above each pocket is an opening to a chute 14. This opening can be closed by a cover 15 operated by a cylinder 16. The top of the chute can also be closed by a similar cover 17 and cylinder 18. In addition, the chute is provided with a steam inlet 19 and a combined steam and air outlet 20.

Grinding is initiated by setting the shaft 2 in rotation by means of the motor 4. Live steam is then introduced through the steam intake 6 and the grinding apparatus is heated, after which the outlet valve 21 in the bottom of the pressure tank 9 is closed and the grinder is placed under steam pressure. The chute 14 is loaded with pieces of wood and the covers 17 are brought into place. The air in the chutes is driven out through the combined steam and air outlets 20 by the steam introduced through the steam inlets 19. The outlets 20 are then closed and the chute is subjected to the pressure of the steam. The covers 15 move back and the wood contained in the chutes falls into the grinding pockets 10. The covers 15 close again and hot water, carried through the water inlets 7, is sprayed onto the grinding surfaces. The actual grinding is now commenced in that the thrust plates 13 are brought to bear against the wood by means of the plungers 12. The groundwood pulp thus produced, a mixture of wood fibres and water, collects in the housing 5 and falls into the pressure tank 9. The outlet valve 21 is now opened and the pulp is expelled, the size of the valve opening being adjusted so as to ensure that the pulp inside the pressure tank is kept at a constant level.

A chip desintegrator or "fibrilizer" 22, comprising knives rotating on a shaft, should be mounted just before the outlet valves in order to chop up any large pieces of wood contained in the pulp and obviate the danger of blocked pipes, valves, etc.

After it has been expelled from the pressure tank, the pulp is collected in a chest where it is diluted with white water until it is of an appropriate concentration for screening, vortex cleaning, thickening, etc., and further processing into paper, cardboard, etc.

During the grinding process steam is expelled from the chute 14 via the outlets 20. The covers 17 are opened, new wood is loaded into the chute, the covers are closed, the air is expelled and steam pressure builds up in the chute as described above.

Once all the wood in a pocket has been ground to a pulp, the thrust plate 13 is drawn back, the cover 15 opens and the new wood falls into the pocket. The pressure cycles of the four pockets are staggered so that only one thrust plate is unloaded at a time, thereby limiting the reduction of the load on the motor 4 to 25%.

The fineness of the pulp is regulated by adjusting the pressure exerted by the plungers. Any increase of pressure gives a finer grind at the same time as production rises.

When the grinder is operating with all four thrust plates adjusted to exert identical pressure, the grinding disc will be in perfect axial balance: it will not be subjected to deflection and no axial load will be set up in its bearings. Only during a change of grinding status in one of the pockets will the disc and bearings be subjected to any extra load, and this will amount to only 25% of the total pressure of the thrust plates.

FIG. 4 shows part of the surface of the grinding disc. The grinding surface may be manufactured of a single piece of material but is better built up of a number of separate, removable plates of steel, cast iron, some hard metal alloy, hardmetal or other material having high resistance to wear. In the embodiment illustrated in the figure, the grinding pattern consists of ribs oriented in an essentially radial direction and projecting from the surface of the disc so as to form a number of grooves between them. The wood or material to be processed is acted on by the ribs, particularly by the leading edges of these, while the pulp so produced, i.e. the mixture of fibres and water, is carried outwards through the grooves by centrifugal force and collects in the housing here designated 5.

FIG. 5 shows an alternative grinding pattern in which teeth are provided along the radii of the grinding surface.

Once the leading edge of the ribs or teeth has become rounded by wear after a period in operation, the direction of rotation of the disc may be changed so as to allow the other edge to become the leading one. As the ribs are worn down, what was previously the leading edge is resharpened and the direction of rotation may once again be changed after a period of operation. The walls of the grinding pockets closest to the grinding surfaces may be fitted with adjustable doctors, or else the entire pocket may be made displaceable so that as the ribs or teeth are worn out a small gap only is constantly maintained between the edges of the pocket and the grinding surface.

As indicated above, the production capacity of the grinder is dependent on the fineness of the pulp itself, which may be made more or less fine by adjustment of the pressure prevailing on the disc. It is also influenced by the diameter and speed of rotation of the disc, which may be considerably faster than in conventional grinders.

As indicated above, the liquid conveyed to the centre of the grinding disc may consist of water. This water should be hot, between 40° and 90° C., and white water recycled from the grinding process is suitable for the purpose. The friction heat generated during grinding in combination with any steam introduced will quickly cause the temperature of the water and pulp to rise to a level corresponding to the saturation state of the steam kept at greater-than-atmospheric pressure inside the housing. A suitable absolute pressure would be between 150 and 250 kPa, corresponding to a temperature of approx. 100°–130° C. (For production of brown mechanical pulp, however, much higher pressures are needed, in the region of 500 kPa or more.) Any surplus steam is evacuated through an outlet 23 regulated by a valve 24 for maintaining the pressure at a constant level. At this temperature the lignin between the wood fibres is softened and the fibres can be liberated undamaged with only a small amount of energy being consumed. It is also possible to add chemicals to the water to control the pH-value of the pulp, to make the pulp lighter in colour or to facilitate liberation of the fibres by chemical action on the lignin.

The embodiment of the device of the invention described above can be modified in a number of ways. One, two or more grinding zones, in a variety of arrangements, may be provided on one or both of the end surfaces of the grinding disc. The wood may be introduced into the pockets by several methods. The elements for holding and exerting pressure on the material to be ground may be of a type other than described in the present, e.g. comprising chains or screws. The pressure in the housing may be maintained by a medium other than water vapour, e.g. air or some inert gas. The grinding surface may, for example, comprise grains of ceramic material embedded in a binding agent. The pulp may be passed through the lock of the pressure housing by a number of different methods.

I claim:

1. A device for the production of mechanical pulp from a lignocellulose material comprising a grinding disc (1) having two opposed end surfaces and rotating around a shaft (2) running at right-angles through the center of each of said end surfaces of the disc, and means (10–13) for holding and pressing one or more pieces of the material to be processed against both of said end surfaces, each of said opposed end surfaces defining a grinding surface oriented in the plane of said grinding surfaces; and inlet means for introducing a liquid medium during a grinding operation, characterized in that the grinding disc is enclosed in a housing (5) kept at above-atmospheric pressure; in that the means for holding the material to be processed is so designed as to hold the pieces of such material with their fibers largely pointing in a direction outwards from the center of the grinding disc; in that the means (7) for introducing liquid is so designed as to carry said liquid to the center of the grinding disc; in that said means for holding the material to be processed includes a plurality of pockets (10) located adjacent to each of said two opposed end surfaces; and in that the pockets located adjacent to one of said end surfaces face the pockets located adjacent to the opposed end surface, the material to be processed being introduced via a chute (14) located adjacent to each of said pockets.

2. Device according to claim 1 further characterized in that the absolute pressure obtained in the housing (5) is in the range of 100 kilo Pascals to 1,000 kilo Pascals.

3. Device according to claims 1 or 2 further characterized in that said pockets (10) remain stationary in relation to the grinding disc; in that said chute (14) may be closed and subjected to a pressure greater that atmospheric; and in that means (13) for exerting pressure work in coordination with said pockets for the purpose of holding the material to be processed firmly pressed against said grinding surfaces.

* * * * *